US006512482B1

(12) United States Patent
Nelson et al.

(10) Patent No.: US 6,512,482 B1
(45) Date of Patent: Jan. 28, 2003

(54) METHOD AND APPARATUS USING A SEMICONDUCTOR DIE INTEGRATED ANTENNA STRUCTURE

(75) Inventors: Michael D. Nelson, Mountain View, CA (US); Austin H. Lesea, Los Gatos, CA (US); Antolin S. Agatep, San Francisco, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 09/813,561

(22) Filed: Mar. 20, 2001

(51) Int. Cl.[7] ..... H01Q 1/38

(52) U.S. Cl. ..... 343/700 MS; 343/795; 343/895

(58) Field of Search ..... 343/700 MS, 702, 343/795, 895, 767, 769, 725, 729; H01Q 1/38

(56) References Cited

U.S. PATENT DOCUMENTS 5,019,829 A 5/1991 Heckman et al. .... 343/700 MS
5,023,624 A 6/1991 Heckaman et al. ..... 343/866
5,142,698 A 8/1992 Koga et al. ..... 455/327
5,612,513 A * 3/1997 Tuttle et al. ..... 174/260
6,061,025 A 5/2000 Jackson et al. ..... 343/700 MS
6,326,544 B1 * 12/2001 Lake ..... 174/52.2
6,373,447 B1 * 4/2002 Rostoker et al. ..... 343/895

OTHER PUBLICATIONS

Mannion, Patrick; "Single–radio point–to–point delivers 311 Mbits/s"; EE Times article published Feb. 20, 2001 at www.eet.com/story/OEG20010220S0085.

* cited by examiner

*Primary Examiner*—Hoanganh Le
(74) *Attorney, Agent, or Firm*—Pablo Meles; Akerman, Senterfitt & Eidson, P.A.

(57) ABSTRACT

A communication device (50) operating at a plurality of frequencies has a processor (36) coupled to a semiconductor die integrated antenna structure (30) having a first integrated antenna (14) tuned to a first frequency and coupled to a first circuit (17) and at least a second integrated antenna (18) tuned to a second frequency and coupled to a second circuit (21). The processor controls either the first circuit or the second circuit or both.

20 Claims, 3 Drawing Sheets

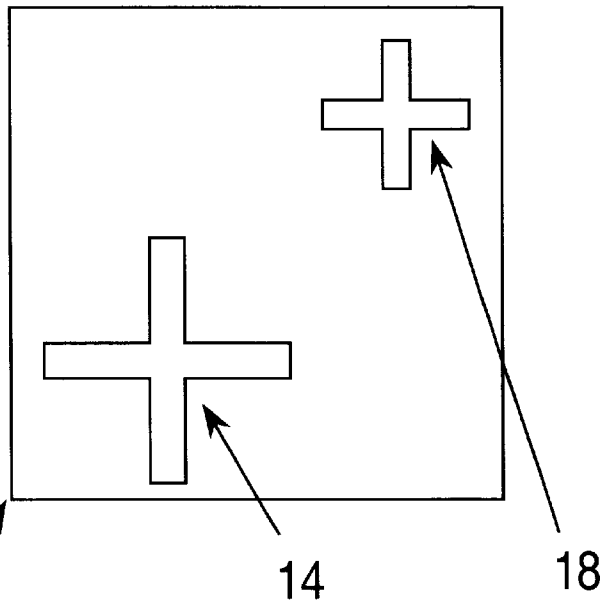
FIG.1
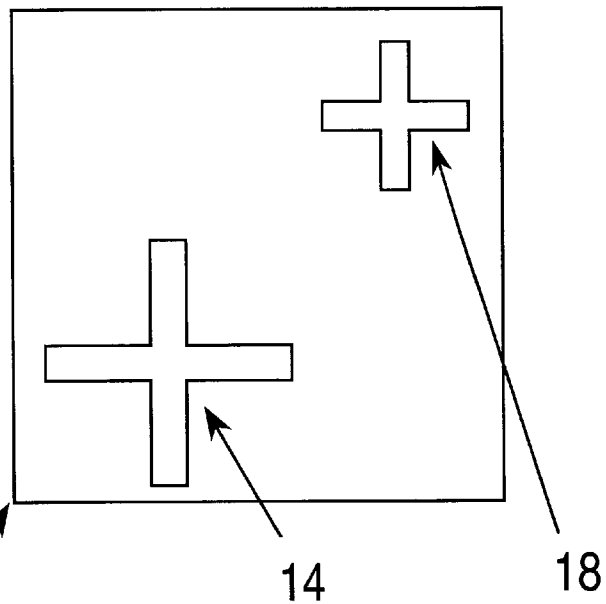
FIG.3
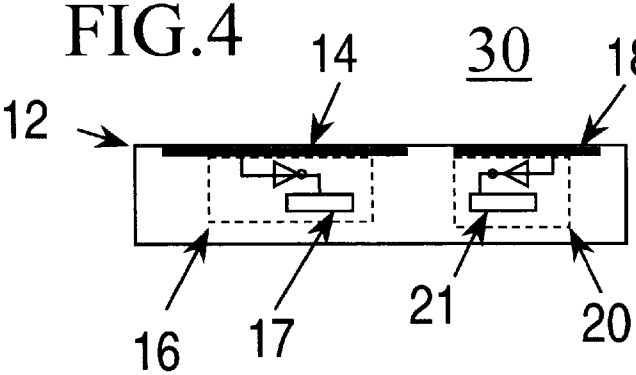
FIG.2
FIG.4

METHOD AND APPARATUS USING A SEMICONDUCTOR DIE INTEGRATED ANTENNA STRUCTURE

FIELD OF THE INVENTION

This invention relates generally to a semiconductor die having an integrated antenna structure, an more particularly to an antenna structure having at least two integrated antennas tuned to different frequencies.

BACKGROUND OF THE INVENTION

U.S. Pat. No. 5,142,698 to Koga et al. discusses a microwave integrated apparatus that includes two antennas tuned for receiving a satellite broadcast signal. U.S. Pat. No. 5,019,829 to Heckman et al. discusses another microwave integrated circuit having a single cover-mounted antenna. U.S. Pat. No. 5,023,624 to Heckaman et al. discusses a microwave chip carrier package having a single cover-mounted antenna element. U.S. Pat. No. 6,061,025 to Jackson et al. discusses a die integrated tunable antenna structure.

With the advent of ubiquitous wireless communication between and among people and other devices, a device that inexpensively and simply supports multiple protocols and standards at different frequencies will be highly desirable. Ideally such devices will support and improve signal quality and performance across both widely disparate spectrum (as in the case of cellular phones using two widely separated frequencies that would be useful in avoiding multi-path fading) and narrower spectrum. In the near future, wireless communication devices (pagers, cell phones, etc.) will begin incorporating secondary wireless protocols (such as Bluetooth, HomeRF, IEEE 802.11, etc.) that operate at the narrower spectrum and at lower power and over shorter distances. These secondary protocols generally use unlicensed spectrum in the ISM band and require minimal coordination with the primary communication protocol of a device (e.g., GSM, IS-95, IS-136, ReFLEX, etc.).

Potential applications of these low-power, short-range, secondary protocols are wireless connection of peripheral devices, high-speed data transfers to desktop computers and wireline networks, and establishment of short-range "piconets" between similar wireless devices. These devices in many instances will also operate either independently or dependently with a primary protocol such as the well known cellular protocols operating at different frequencies.

Thus, a need exists for a die integrated structure that has a plurality of integrated antennas capable of addressing the requirements of wireless devices that will operate on multiple frequencies.

SUMMARY OF THE INVENTION

In a first aspect of the present invention, a semiconductor die integrated antenna structure comprises a first integrated antenna tuned to a first frequency and coupled to a first circuit and at least a second integrated antenna tuned to a second frequency and coupled to a second circuit.

In a second aspect of the present invention, a communication device operating at a plurality of frequencies comprises a processor coupled to a semiconductor die integrated antenna structure having a first integrated antenna tuned to a first frequency and coupled to a first circuit and at least a second integrated antenna tuned to a second frequency and coupled to a second circuit. The processor controls either the first circuit or the second circuit or both.

In a third aspect of the present invention, a method of transmitting and receiving a plurality of signals at a plurality of antennas in a semiconductor die integrated antenna structure comprises the steps of providing a first and at least a second integrated antenna tuned to respective first and second frequencies and further coupled to respective first and second transceiver circuits and respective first and second modems. The method further comprises the steps of transmitting and receiving a portion of the plurality of signals at the first frequency and transmitting and receiving another portion of the plurality of signals at the second frequency.

BRIEF DESCRIPTION OF THE DRAWINGS

FIG. 1 is a simplified top-down diagram of a die integrated antenna structure in accordance with the present invention.

FIG. 2 is a cross-sectional diagram of the die integrated antenna structure of FIG. 1 shown in accordance with the present invention.

FIG. 3 is a simplified top-down diagram of another die integrated antenna structure in accordance with the present invention.

FIG. 4 is a cross-sectional diagram of the die integrated antenna structure of FIG. 3 shown in accordance with the present invention.

DETAILED DESCRIPTION OF THE DRAWINGS

Figure 6:
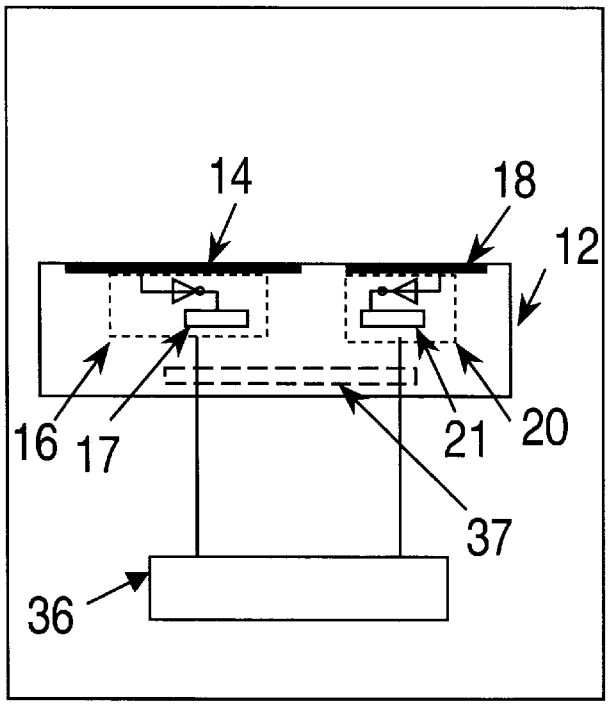
FIG. 6 is a block diagram of a communication device in accordance with the present invention.

Referring to FIGS. 1 and 2, there is shown a simplified top-down diagram and a cross-sectional diagram respectively of a semiconductor die integrated antenna structure 10 having a semiconductor die 12 with a first integrated antenna 14 tuned to a first frequency and coupled to a first circuit 16. The structure 10 further comprises at least a second integrated antenna 18 tuned to a second frequency and coupled to a second circuit 20. Preferably, the first integrated antenna 14 and the second integrated antenna 18 concurrently transmit without creating appreciable interference with each other. The first circuit 16 is preferably a transmitter circuit, a transceiver circuit, or a receiver circuit. Likewise, the second circuit 20 is preferably a transmitter circuit, a transceiver circuit, or a receiver circuit. The plurality of two or more die integrated antennas addresses the needs of ubiquitous wireless communication by providing for a device designed for easy manufacturability and integration with other wireless system components. By using multiple antenna instantiations that are tuned to different frequencies rather than using tuning mechanisms, multiple concurrent transmissions and receptions can occur efficiently with improved performance. Antenna switching design complexity is also further simplified by having each antenna instantiation with independent transmit and/or receive circuitry.

The advantages of using die integrated antenna structures include the ability to achieve low cost wireless enabled semiconductor products that provides frequency diversity without the circuit and manufacturing complexities associated with conventional implementations of such combinations. The die integrated antenna structures further enable simultaneous multi-frequency operation for bandwidth aggregation that a single antenna solution cannot provide.

Referring to FIGS. 3 and 4, there is shown another simplified top-down diagram and a cross-section diagram respectively of a semiconductor die integrated antenna structure 30 having a semiconductor die 12 with a first integrated antenna 14 tuned to a first frequency and coupled to a first circuit 16 and at least a second integrated antenna 18 coupled to a second circuit 20 as previously shown in FIGS. 1 and 2. In addition, structure 30 comprises a modem 17 that forms a part of the first circuit 16 and a second modem 21 that forms a part of the second circuit 20 as shown. In this embodiment, each antenna instantiation has a dedicated modem that is necessary for simultaneous multi-frequency transmissions. Ideally, this is generally suited for multi-protocol digital communications that is easier to engineer and implement. The frequencies of the first and second antennas are selected for the desired operating characteristics of the target designs.

Figure 5:
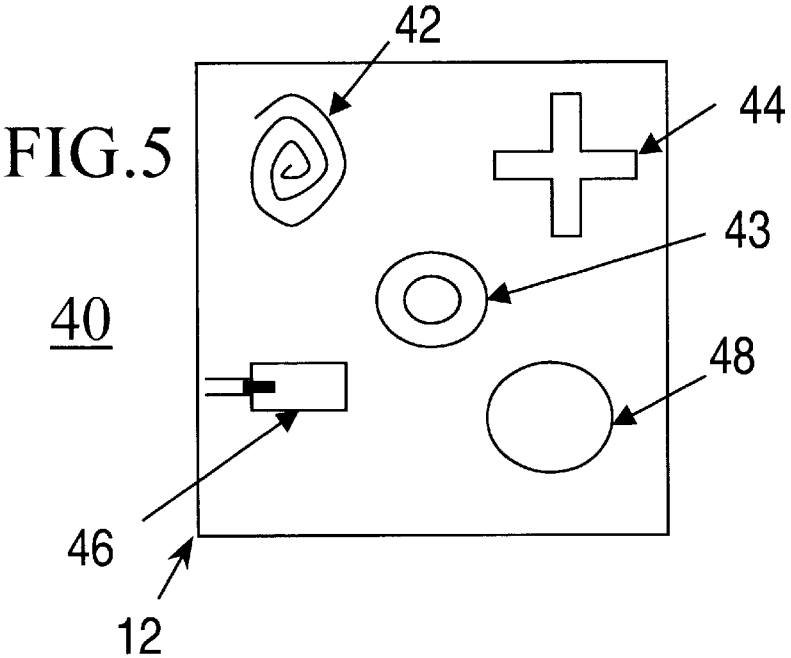
FIG. 5 is a simplified top-down diagram of a die integrated antenna structure showing a variety of antennas in accordance with the present invention.

It should be understood that the present invention is not limited to the antenna design pattern shown in FIGS. 1–4, but could comprise many different variations as shown in FIG. 5, where the antenna patterns can be a patch (48), a dipole (44), a monopole, a loop (43), a ¼ wave open-line (46), or a spiral (42) antenna, or other antenna types including, but not limited to crossed antenna types at 90 degrees orientation fed 90 degrees apart to achieve circular polarization for example.

Referring to FIG. 6, a communication device 50 operating at a plurality of frequencies preferably comprises a processor 36 coupled to a semiconductor die integrated antenna structure 30 having a semiconductor die 12, a first integrated antenna 14 tuned to a first frequency and coupled to a first circuit 17 and at least a second integrated antenna 18 tuned to a second frequency and coupled to a second circuit 21. The processor 36 preferably controls either of the first circuit or the second circuit or both. As described above, the first circuit 17 and the second circuit 21 can each be a receiver circuit, a transmitter circuit or a transceiver circuit. The first and/or second circuits can also take the form of a modem. Alternatively, an embedded processor 37 that can be embedded in the semiconductor die 12 can be used instead of (or in addition to) the separate processor 36 to provide the same functions as processor 36. The embodiments shown in FIG. 6 are ideally suited for both process specific radio/antenna embodiments (using an RF optimized Germanium process for example) as well as fully integrated embodiments using CMOS radio technology.

Figure 7:
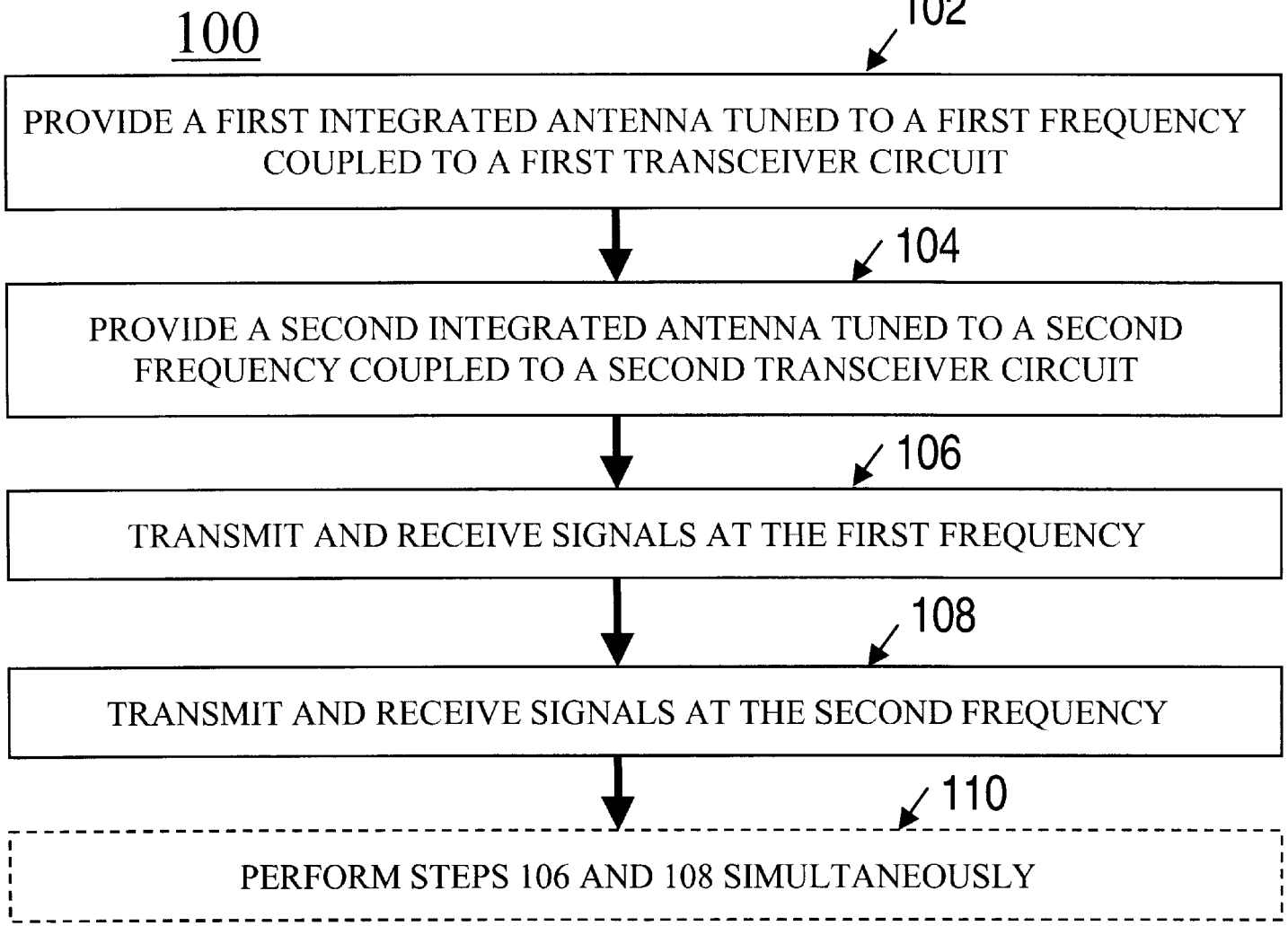
FIG. 7 a flow chart illustrating a method in accordance with the present invention.

Referring to FIG. 7, a flow chart illustrating a method 100 of transmitting and receiving a plurality of signals at a plurality of antennas in a semiconductor die integrated antenna structure is shown. At step 102 a first integrated antenna in the semiconductor die tuned to a first frequency and coupled to a first transceiver circuit and a first modem is provided. At step 104, at least a second integrated antenna in the semiconductor die tuned to a second frequency and coupled to a second circuit and a second transceiver circuit and a second modem is provided. At step 106 a portion of the plurality of signals at the first frequency is either transmitted or received or both. At step 108, another portion of the plurality of signals at the second frequency is either transmitted or received or both. Optionally, at step 110 the transmissions and receptions occurring at steps 106 and 108 can occur simultaneously. In many instances, having two independent channels increases the overall capacity and efficiency of a communication system utilizing more than one frequency.

The description above is intended by way of example only and is not intended to limit the present invention in any way except as set forth in the following claims.

What is claimed is:

1. A semiconductor die integrated antenna structure, comprising:

a first integrated antenna in a semiconductor die tuned to a first frequency and coupled to a first circuit; and at least a second integrated antenna in the semiconductor die tuned to a second frequency and coupled to a second circuit, wherein the first circuit is independent of the second circuit enabling simultaneous multi-frequency transmissions.

2. The structure of claim 1, wherein the first integrated antenna and the at least second integrated antenna concurrently transmit without creating appreciable interference to each other.

3. The structure of claim 1, wherein the first circuit is a transmitter circuit.

4. The structure of claim 1, wherein the first circuit is a receiver circuit.

5. The structure of claim 1, wherein the first circuit is a transceiver circuit.

6. The structure of claim 1, wherein the second circuit is a transmitter circuit.

7. The structure of claim 1, wherein the second circuit is a receiver circuit.

8. The structure of claim 1, wherein the second circuit is a transceiver circuit.

9. The structure of claim 1, wherein the first circuit further comprises a first modem circuit.

10. The structure of claim 1, wherein the second circuit further comprises a second modem circuit.

11. The structure of claim 1, wherein the first antenna and at least the second antenna are selected from the group of antennas comprising patch antennas, dipole antennas, monopole antennas, loop antennas, spiral antennas, ¼ wave open-line antennas, crossed antenna types at 90 degrees orientation fed 90 degrees apart to achieve circular polarization, and any combination thereof.

12. A communication device operating at a plurality of frequencies, comprising:

a semiconductor die integrated antenna structure comprising a first integrated antenna in a semiconductor die tuned to a first frequency and coupled to a first circuit and at least a second integrated antenna in the semiconductor die tuned to a second frequency and coupled to a second circuit; and a processor embedded in the semiconductor die for controlling either of the first circuit or the second circuit.

13. The communication device of claim 12, wherein the first integrated antenna and the at least second integrated antenna concurrently transmit without creating appreciable interference with each other.

14. The communication device of claim 12, wherein the first circuit is selected from the group comprising a transmitter circuit, a receiver circuit, or a transceiver circuit.

15. The communication device of claim 12, wherein the second circuit is selected from the group comprising a transmitter circuit, a receiver circuit, or a transceiver circuit.

16. The communication device of claim 12, wherein the first circuit further comprises a first modem circuit.

17. The communication device of claim 12, wherein the second circuit further comprises a second modem circuit.

18. The communication device of claim 12, wherein the processor is embedded in the semiconductor die.

19. A method of transmitting and receiving a plurality of signals at a plurality of antennas in a semiconductor die integrated antenna structure, comprising the steps of:

providing a first integrated antenna in the semiconductor die tuned to a first frequency and coupled to a first transceiver circuit and a first modem in the semiconductor die;

providing at least a second integrated antenna in the semiconductor die tuned to a second frequency and coupled to a second transceiver circuit and a second modem in the semiconductor die;

transmitting and/or receiving a portion of the plurality of signals at the first frequency; and transmitting and/or receiving another portion of the plurality of signals at the second frequency.

20. The method of claim 19, wherein the method further comprises the step of transmitting at the first frequency from the first integrated antenna and transmitting at the second frequency from the second integrated antenna.

* * * * *